US011373595B2

(12) United States Patent
Iwauchi

(10) Patent No.: US 11,373,595 B2
(45) Date of Patent: Jun. 28, 2022

(54) DISPLAY DEVICE AND METHOD FOR DRIVING DISPLAY DEVICE

(71) Applicant: JOLED INC., Tokyo (JP)

(72) Inventor: Eiji Iwauchi, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/381,512

(22) Filed: Jul. 21, 2021

(65) Prior Publication Data

US 2022/0036823 A1 Feb. 3, 2022

(30) Foreign Application Priority Data

Jul. 30, 2020 (JP) ..... JP2020-129650

(51) Int. Cl.
*G09G 3/3233* (2016.01)

(52) U.S. Cl.
CPC ... *G09G 3/3233* (2013.01); *G09G 2320/0285* (2013.01); *G09G 2360/16* (2013.01)

(58) Field of Classification Search
CPC ..... G09G 3/3233; G09G 2320/0285; G09G 2360/16
See application file for complete search history.

(56) References Cited

U.S. PATENT DOCUMENTS

2005/0024546 A1* 2/2005 Kubo ..... G02F 1/133753 349/33
2021/0217368 A1* 7/2021 Sohn ..... G09G 3/3291
2021/0335282 A1* 10/2021 Sohn ..... G09G 3/3208

FOREIGN PATENT DOCUMENTS

EP 3852094 7/2021
JP 2005-055880 3/2005
JP 2016-109939 6/2016

OTHER PUBLICATIONS

Extended European Search Report (EESR) from European Patent Office (EPO) in European Patent Application No. 21185007.8, dated Jan. 5, 2022.

* cited by examiner

*Primary Examiner* — Kenneth B Lee, Jr.
(74) *Attorney, Agent, or Firm* — Greenblum & Bernstein, P.L.C.

(57) ABSTRACT

A display device includes: luminance converter that converts an input gradation value into a target luminance value corresponding to the input gradation value; correction calculator that calculates an output gradation value from the target luminance value and calculates a corrected luminance value from the output gradation value using an efficiency residual rate; cumulative stress calculator that updates the efficiency residual rate using a cumulative stress amount obtained by converting a stress amount on the light emitting element calculated from the corrected luminance value into a first stress amount at a reference current and accumulating a second stress amount obtained by converting the converted first stress amount according to a frame rate; and stress amount converter that converts the first stress amount into the second stress amount by multiplying the first stress amount by a conversion coefficient corresponding to the frame rate obtained from the video signal.

6 Claims, 16 Drawing Sheets

FIG. 10A

| Frame rate (FPS) | 20 | 30 | 40 | 48 | 50 | 60 | 120 | 196 | 240 |
|---|---|---|---|---|---|---|---|---|---|
| Conversion coefficient | 0.05 | 0.033333 | 0.025 | 0.020833 | 0.02 | 0.016667 | 0.008333 | 0.005102 | 0.004167 |

FIG. 10B

| Frame rate (FPS) | 20 | 30 | 40 | 48 | 50 | 60 | 120 | 196 | 240 |
|---|---|---|---|---|---|---|---|---|---|
| Conversion coefficient | 3 | 2 | 1.5 | 1.25 | 1.2 | 1 | 0.5 | 0.306122 | 0.25 |

DISPLAY DEVICE AND METHOD FOR DRIVING DISPLAY DEVICE

CROSS REFERENCE TO RELATED APPLICATION

The present application is based on and claims priority of Japanese Patent Application No. 2020-129650 filed on Jul. 30, 2020. The entire disclosure of the above-identified application, including the specification, drawings and claims is incorporated herein by reference in its entirety.

FIELD

The present disclosure relates to a display device and a method for driving the display device.

BACKGROUND

It is known that in a self-luminous element such as an organic electro luminescence (EL) element, the light emitting layer included in the self-luminous element deteriorates according to the amount of light emitted, the light emitting time, and the temperature.

When the luminance decreases due to the deterioration of the light emitting layer, for example, burn-in such as after-image or fading may occur, color shift may occur in the image displayed on the display, or the luminance of a part of the display may decrease, resulting in display unevenness on the display.

In order to solve such a problem, a technique for reducing display unevenness by correcting a video signal is disclosed (see, for example, Patent Literature (PTL) 1).

CITATION LIST

Patent Literature

PTL 1: Japanese Unexamined Patent Application Publication No. 2016-109939

SUMMARY

Technical Problem

However, in the above-mentioned conventional technique, the case where the input drive frequency of the video signal, that is, the frame rate changes is not taken into consideration. For this reason, when the frame rate of the video displayed on the display changes, a correction error occurs even if the video signal is corrected, and there is a possibility that display unevenness may occur on the display.

The present disclosure has been made in view of the above circumstances, and an object of the present disclosure is to provide a display device and a method for driving the display device, which can reduce display unevenness even when the frame rate changes.

Solution to Problem

The display device according to the present disclosure is a display device including a display screen in which a plurality of pixels each including a light emitting element are arranged in a matrix, the display device comprising: a correction circuit that corrects an input gradation value indicated by a luminance signal included in a video signal, wherein the correction circuit includes: a luminance converter that converts the input gradation value into a target luminance value corresponding to the input gradation value; a correction calculator that calculates an output gradation value obtained by correcting the input gradation value from the target luminance value and calculates a corrected luminance value obtained by correcting the target luminance value from the output gradation value using an efficiency residual rate which is an index indicating a degree of deterioration of the light emitting element and which indicates a residual rate of a luminous efficiency of the light emitting element; a cumulative stress calculator that converts a stress amount on the light emitting element calculated from the corrected luminance value into a first stress amount indicating a stress amount when a reference current flows through the light emitting element, and updates the efficiency residual rate using a cumulative stress amount obtained by accumulating a second stress amount obtained from the first stress amount converted and obtained by converting the first stress amount according to a frame rate obtained from the video signal; and a stress amount converter that converts the first stress amount into the second stress amount by acquiring the frame rate obtained from the video signal and multiplying the first stress amount by a conversion coefficient corresponding to the frame rate acquired.

Advantageous Effects

According to the present disclosure, it is possible to provide a display device and a method for driving the display device, which can reduce display unevenness even when the frame rate changes.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 10A is a diagram showing an example of a look-up table according to Example 1 of the embodiment.

FIG. 10B is a diagram showing an example of a look-up table according to Example 1 of the embodiment.

DESCRIPTION OF EMBODIMENT

Figure 1:
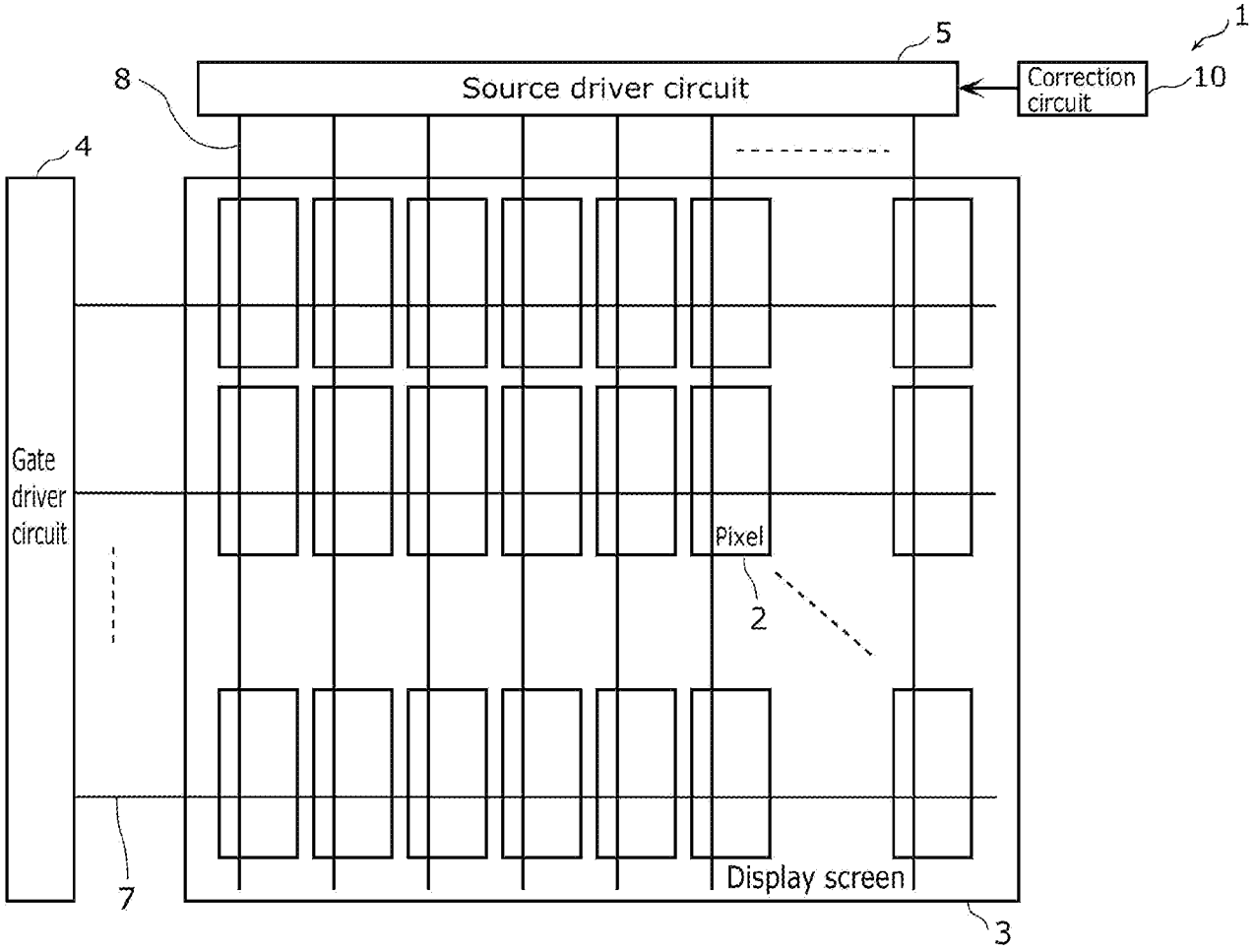
FIG. 1 is a schematic diagram showing a configuration of a display device according to an embodiment.

The display device according to one aspect of the present disclosure is a display device including a display screen in which a plurality of pixels each including a light emitting element are arranged in a matrix, the display device comprising: a correction circuit that corrects an input gradation value indicated by a luminance signal included in a video signal, wherein the correction circuit includes: a luminance converter that converts the input gradation value into a target luminance value corresponding to the input gradation value; a correction calculator that calculates an output gradation value obtained by correcting the input gradation value from the target luminance value and calculates a corrected luminance value obtained by correcting the target luminance value from the output gradation value using an efficiency residual rate which is an index indicating a degree of deterioration of the light emitting element and which indicates a residual rate of a luminous efficiency of the light emitting element; a cumulative stress calculator that converts a stress amount on the light emitting element calculated from the corrected luminance value into a first stress amount indicating a stress amount when a reference current flows through the light emitting element, and updates the efficiency residual rate using a cumulative stress amount obtained by accumulating a second stress amount obtained from the first stress amount converted and obtained by converting the first stress amount according to a frame rate obtained from the video signal; and a stress amount converter that converts the first stress amount into the second stress amount by acquiring the frame rate obtained from the video signal and multiplying the first stress amount by a conversion coefficient corresponding to the frame rate acquired.

According to this configuration, display unevenness can be reduced even when the frame rate changes. More specifically, even when the frame rate changes, the stress amount suitable for the changed frame rate can be calculated, so that the cumulative stress amount can be calculated accurately. For this reason, since the degree of deterioration of the light emitting element can be accurately predicted using the efficiency residual rate, the corrected input gradation value in consideration of the degree of deterioration of the light emitting element, that is, the output gradation value can be calculated. With this, it is possible to correct each light emitting element to a uniform light emitting luminance regardless of the degree of deterioration of each light emitting element, so that display unevenness can be reduced.

In addition, the stress amount calculated from the corrected luminance value is a stress amount at a first current flowing through the light emitting element when the light emitting element is made to emit light with the corrected luminance value, the stress amount at the first current is a time during which the first current flows through the light emitting element, the stress amount at the reference current is a time during which the reference current flows through the light emitting element, the cumulative stress calculator converts the stress amount calculated from the corrected luminance value into the first stress amount by converting the time during which the first current flows through the light emitting element into the time during which the reference current flows through the light emitting element, and may calculate the cumulative stress amount by calculating a cumulative time obtained by accumulating a time corresponding to the frame rate, which is the time during which the reference current flows through the light emitting element, which is the second stress amount.

According to this configuration, since the stress amount is evaluated by the time during which the reference current flows through the light emitting element, even if the frame rate changes, the stress amount suitable for the changed frame rate can be calculated, and the cumulative stress amount can be calculated accurately.

In addition, the efficiency residual rate is represented by a ratio of an emission luminance after deterioration of the light emitting element to an initial emission luminance of the light emitting element, and the cumulative stress calculator may update the efficiency residual rate by setting the efficiency residual rate to a new efficiency residual rate calculated from the cumulative time calculated as the cumulative stress amount by using a relationship between a luminance of the light emitting element and the cumulative time during which the reference current flows through the light emitting element.

In addition, the stress amount converter may include: a look-up table that stores a plurality of frame rates and a conversion coefficient associated with each of the plurality of frame rates in advance; and a frame rate converter that converts the first stress amount into the second stress amount by acquiring the frame rate obtained from the video signal, selecting, from the lookup table, the conversion coefficient corresponding to the frame rate acquired, and multiplying the first stress amount by the conversion coefficient.

In addition, the stress amount converter may include: a storage that stores a calculation formula for calculating the conversion coefficient, the calculation formula expressed by a ratio having the frame rate as a denominator; a conversion coefficient calculator that converts the first stress amount into the second stress amount by acquiring the frame rate obtained from the video signal, obtaining the conversion coefficient corresponding to the frame rate by applying the frame rate acquired to the calculation formula, and multiplying the first stress amount by the conversion coefficient.

In addition, the method for driving the display device according to one aspect of the present disclosure is a method for driving a display device including a display screen in which a plurality of pixels each including a light emitting element are arranged in a matrix, the method comprising: correcting an input gradation value indicated by a luminance signal included in a video signal, wherein the correcting includes: converting the input gradation value into a target luminance value corresponding to the input gradation value; calculating an output gradation value obtained by correcting the input gradation value from the target luminance value and calculates a corrected luminance value obtained by correcting the target luminance value from the output gradation value using an efficiency residual rate which is an index indicating a degree of deterioration of the light emitting element and which indicates a residual rate of a luminous efficiency of the light emitting element; updating the efficiency residual rate by converting a stress amount on the light emitting element calculated from the corrected luminance value into a first stress amount indicating the stress amount when a reference current flows through the light emitting element, and accumulating a second stress amount obtained from the first stress amount converted and obtained by converting the first stress amount according to a frame rate obtained from the video signal; and converting the first stress amount into the second stress amount by acquiring the frame rate obtained from the video signal and multiplying the first stress amount by a conversion coefficient corresponding to the frame rate acquired.

Hereinafter, embodiments of the present disclosure will be described with reference to the drawings. Each of the embodiments described below shows a preferred specific example of the present disclosure. Therefore, the numerical values, shapes, materials, components, arrangement positions and connection forms of the components, and the like shown in the following embodiments are examples and are not intended to limit the present disclosure. Therefore, among the components in the following embodiments, the components not described in the independent claims indicating the highest level concept of the present disclosure will be described as arbitrary components.

It should be noted that each figure is a schematic view and is not necessarily exactly illustrated. In addition, in each figure, the same reference numerals are given to substantially the same configurations, and duplicate description will be omitted or simplified.

EMBODIMENT

[Configuration of Display Device]

Display device 1 according to the present disclosure is a display device including a display screen in which a plurality of pixels each including a light emitting element are arranged in a matrix.

Hereinafter, the configuration of display device 1 according to the present embodiment will be described.

FIG. 1 is a schematic view showing the configuration of display device 1 according to the present embodiment.

In the present embodiment, as shown in FIG. 1, display device 1 includes display screen 3, gate driver circuit 4, source driver circuit 5, and correction circuit 10.

<Display Screen 3>

Display screen 3 displays a video based on a video signal input to display device 1 from the outside. Here, the video signal includes at least a luminance signal, a vertical synchronization signal, and a horizontal synchronization signal. The video signal may further include frame rate information. It should be noted that in the present embodiment, the luminance signal indicates the luminance of each sub-pixel of each pixel included in display screen 3 as a gradation value. Hereinafter, the gradation value indicated by the luminance signal is referred to as an input gradation value.

In addition, as shown in FIG. 1, display screen 3 includes a plurality of pixels 2 arranged in a matrix, and a row-shaped scanning line 7 and a column-shaped data line 8 are wired.

<Pixel 2>

Figure 2:
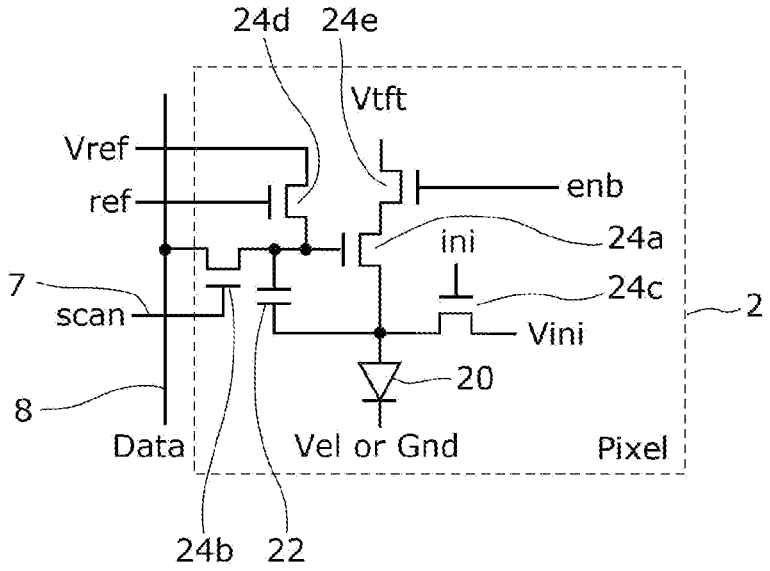
FIG. 2 is a circuit diagram showing a configuration of a pixel according to the embodiment.

FIG. 2 is a circuit diagram showing the configuration of pixel 2 according to the present embodiment.

Each of the plurality of pixels 2 is electrically connected to scanning line 7 and data line 8. More specifically, as shown in FIG. 1, each of the plurality of pixels 2 is arranged at a position where scanning line 7 and data line 8 intersect. In addition, the plurality of pixels 2 are arranged in, for example, N rows and M columns. N and M are positive integers and differ depending on the size and resolution of display screen 3.

In the present embodiment, as shown in FIG. 2, reference power supply line Vref, EL anode power supply line Vtft, EL cathode power supply line Vel, initialization power supply line Vini, reference voltage control line ref, initialization control line ini, and enable line enb are wired in pixel 2. Here, EL anode power supply line Vtft supplies the anode voltage applied to light emitting element 20. It should be noted that EL cathode power supply line Vel supplies a cathode voltage applied to light emitting element 20. It should be noted that EL cathode power supply line Vel may be grounded. Initialization power supply line Vini supplies an initialization voltage for initializing capacitive element 22.

In addition, as shown in FIG. 2, pixel 2 includes light emitting element 20, capacitive element 22, drive transistor 24*a*, and switching transistors 24*b* to 24*e*.

The cathode of light emitting element 20 is connected to EL cathode power supply line Vel, and the anode thereof is connected to the source of drive transistor 24*a*. Light emitting element 20 emits light with luminance corresponding to the signal voltage by flowing a current corresponding to the signal voltage of the video signal (luminance signal) supplied from drive transistor 24*a*. In the present embodiment, the current corresponding to the signal voltage of the video signal is the current corresponding to the signal voltage of the video signal corrected by correction circuit 10. Although the details will be described later, the current corresponding to the signal voltage of the video signal corrected by correction circuit 10 is a current corresponding to a gradation value, of the luminance indicated by the luminance signal included in the video signal, that has been corrected by correction circuit 10 (output gradation value).

Light emitting element 20 is an organic EL element such as an organic light emitting diode (OLED) and the like. It should be noted that light emitting element 20 is not limited to the organic EL element, and may be a self-luminous element such as an inorganic EL element or a QLED, or may not be a self-luminous element as long as it is an element controlled by current drive.

In drive transistor 24*a*, the gate is connected to one electrode of capacitive element 22 or the like, the drain is connected to the source of switching transistor 24*e*, and the source is connected to the anode of light emitting element 20. In FIG. 2, the source is further connected to the other electrode of capacitive element 22 or the like. Drive transistor 24*a* converts the signal voltage applied between the gate and the source into a current corresponding to the signal voltage (referred to as a current between the drain and the source). Then, when drive transistor 24*a* is turned on, a current between the drain and the source is applied (supplied) to light emitting element 20 to cause light emitting element 20 to emit light. Drive transistor 24*a* is configured by, for example, an n-type thin film transistor (n-type TFT).

In switching transistor 24*e*, the gate is connected to enable line enb, one of the source and drain is connected to EL anode power supply line Vtft, and the other of the source and drain is connected to the drain of drive transistor 24*a*. Switching transistor 24*e* is turned on or off depending on the quenching signal supplied from enable line enb. When switching transistor 24*e* is turned on, drive transistor 24*a* is connected to EL anode power supply line Vtft, and the current between the drain and the source of drive transistor 24*a* is supplied to light emitting element 20. Switching transistor 24*e* is configured by, for example, an n-type thin film transistor (n-type TFT).

In switching transistor 24*b*, the gate is connected to scanning line 7, one of the source and drain is connected to data line 8, and the other of the source and drain is connected to one electrode of capacitive element 22. Switching transistor 24*b* is turned on or off depending on the control signal supplied from scanning line 7. When switching transistor 24*b* is turned on, the signal voltage of the video signal supplied from data line 8 is applied to the electrode of capacitive element 22, and the electric charge corresponding to the signal voltage is accumulated in capacitive element 22. Switching transistor 24*e* is configured by, for example, an n-type thin film transistor (n-type TFT).

In switching transistor 24*d*, the gate is connected to reference voltage control line ref, one of the source and drain is connected to reference power supply line Vref, and the other of the source and drain is connected to one electrode of capacitive element 22 or the like. Switching transistor 24*d* is turned on or off depending on the control signal supplied from reference voltage control line ref. When switching transistor 24*d* is turned on, the electrode of capacitive element 22 is set to the voltage supplied by reference power supply line Vref. Switching transistor 24*d* is configured by, for example, an n-type thin film transistor (n-type TFT).

In switching transistor 24*c*, the gate is connected to initialization control line ini, one of the source and drain is connected to the source of drive transistor 24*a*, and the other of the source and drain is connected to initialization power supply line Vini. Switching transistor 24*c* is turned on or off depending on the control signal supplied from initialization control line ini. When drive transistor 24*a* is in the on state, switching transistor 24*e* is in the off state, and the connection with EL anode power supply line Vtft is cut off, switching transistor 24*c* is turned on to set the anode of light emitting element 20 to the initialization voltage (reference voltage) supplied by initialization power supply line Vini. Switching transistor 24*c* is configured by, for example, an n-type thin film transistor (n-type TFT).

Capacitive element 22 is a capacitor in which one electrode is connected to the gate of drive transistor 24*a*, the source of switching transistor 24*b*, and the source of switching transistor 24*d*, and the other electrode is connected to the source of drive transistor 24*a*. Capacitive element 22 accumulates the electric charge corresponding to the signal voltage supplied from data line 8. Capacitive element 22 stably holds the voltage between the gate and the source of drive transistor 24*a*, for example, after switching transistor 24*b* and switching transistor 24*d* are turned off. In this way, capacitive element 22 applies a voltage between the gate and source of drive transistor 24*a* depending on the signal potential due to the accumulated charge when switching transistor 24*b* and switching transistor 24*d* are in the off state.

With these configurations, a current can stably flow through light emitting element 20.

It should be noted that the configuration of pixel 2 is not limited to the configuration shown in FIG. 2, and may be another configuration. As the minimum configuration capable of at least functioning as pixel 2, it is only needed to include light emitting element 20, capacitive element 22, drive transistor 24*a*, and switching transistor 24*b*.

Scanning line 7 is arranged for each row of the plurality of pixels 2. One end of scanning line 7 is connected to pixel 2, and the other end of scanning line 7 is connected to gate driver circuit 4. In the example shown in FIG. 2, scanning line 7 is connected to the gate of switching transistor 24*b* arranged in pixel 2.

Data line 8 is arranged for each column of the plurality of pixels 2. One end of data line 8 is connected to pixel 2, and the other end of data line 8 is connected to source driver circuit 5. In the example shown in FIG. 2, data line 8 is connected to the source or drain of switching transistor 24*b*.

<Gate Driver Circuit 4>

Scanning line 7 is connected to gate driver circuit 4, and by outputting a control signal to scanning line 7, the on and off of each transistor included in pixel 2 is controlled. In the example shown in FIG. 2, gate driver circuit 4 supplies a scanning signal to the gate of switching transistor 24*b* arranged in pixel 2 via scanning line 7.

<Source Driver Circuit 5>

Data line 8 is connected to source driver circuit 5, and by outputting a video signal corrected by correction circuit 10 to data line 8, the video signal is supplied to each pixel 2. Source driver circuit 5 writes an output gradation value expressing the luminance indicated by the video signal for each of pixels 2 in the form of a current value or a voltage value through data line 8. In the example shown in FIG. 2, source driver circuit 5 supplies a voltage corresponding to the video signal input to the source or drain of switching transistor 24*b* arranged in pixel 2 via data line 8.

<Correction Circuit 10>

Correction circuit 10 corrects the video signal input from the outside and outputs it to source driver circuit 5. More specifically, correction circuit 10 corrects the input gradation value indicated by the luminance signal included in the video signal and outputs the output gradation value. With this, the output gradation value is output to source driver circuit 5 as the gradation indicated by the luminance signal included in the video signal.

In other words, correction circuit 10 is a circuit for correcting the gradation value (input gradation value) of the luminance indicated by the luminance signal included in the video signal so that light emitting element 20 emits light at the target luminance, that is, the target luminance value. It should be noted that the target luminance value corresponds to the emission luminance value corresponding to the input gradation value in initial light emitting element 20 which has not deteriorated. For this reason, when light emitting element 20 deteriorates, the target luminance value cannot be achieved even if light emitting element 20 emits light by supplying a current of a current value corresponding to the input gradation value indicated by the luminance signal included in the video signal. Therefore, correction circuit 10 corrects the input gradation value indicated by the luminance signal included in the video signal so that the target luminance value can be achieved. With this, light emitting element 20 to which the current corresponding to the corrected input gradation value (output gradation value) is supplied can achieve the target luminance, that is, the target luminance value.

Hereinafter, the configuration of correction circuit 10 will be described.

[Configuration of Correction Circuit 10]

Figure 3:
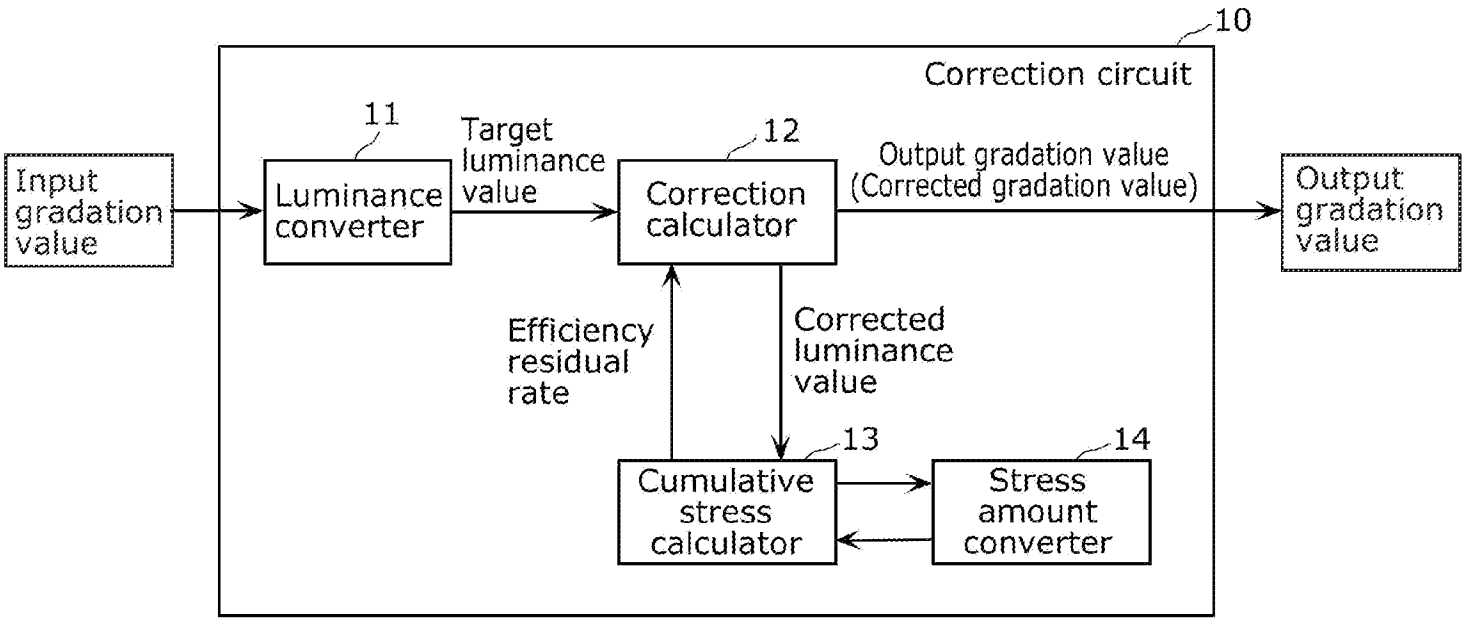
FIG. 3 is a block diagram showing an example of a configuration of a correction circuit according to the embodiment.

FIG. 3 is a block diagram showing an example of the configuration of correction circuit 10 according to the present embodiment.

Correction circuit 10 includes luminance converter 11, correction calculator 12, cumulative stress calculator 13, and stress amount converter 14. Correction circuit 10 can be realized by the processor executing a predetermined program using the memory. Hereinafter, each component will be described.

<Luminance Converter 11>

Luminance converter 11 converts the input gradation value into the corresponding target luminance value. In the present embodiment, luminance converter 11 converts the input gradation value indicated by the luminance signal included in the video signal input from the outside of display device 1 into the corresponding target luminance value.

This will be explained with reference to FIG. 4.

Figure 4:
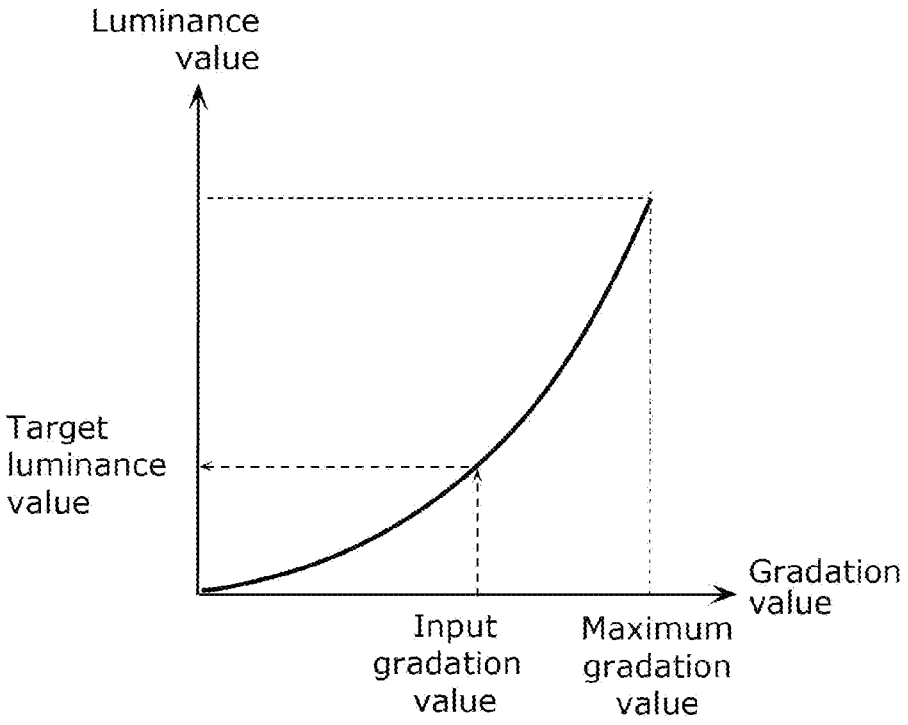
FIG. 4 is a diagram for illustrating a method for converting an input gradation value according to the embodiment into a target luminance value.

FIG. 4 is a diagram for illustrating a method for converting an input gradation value according to the present embodiment into a target luminance value. FIG. 4 shows a gradation luminance characteristic showing a relationship between the gradation value in initial light emitting element 20 and the luminance value.

Using the relationship represented by the gradation luminance characteristic in FIG. 4, luminance converter 11 can convert the input gradation value indicated by the luminance signal included in the video signal input from the outside of display device 1 to the corresponding target luminance value.

<Correction Calculator 12>

Correction calculator 12 calculates an output gradation value obtained by correcting the input gradation value from the target luminance value and calculates a corrected luminance value obtained by correcting the target luminance value from the calculated output gradation value using an efficiency residual rate which is an index indicating a degree of deterioration of the light emitting element and which indicates a residual rate of a luminous efficiency of the light emitting element. Here, the efficiency residual rate is represented by the ratio of the emission luminance after deterioration of light emitting element 20 to the initial emission luminance of light emitting element 20.

In the present embodiment, correction calculator 12 calculates the output gradation value from the target luminance value output from luminance converter 11 by using the efficiency residual rate obtained from cumulative stress calculator 13. Here, the output gradation value is a corrected gradation value obtained by correcting the input gradation value represented by the luminance signal included in the video signal input from the outside of display device 1. Correction calculator 12 outputs the calculated output gradation value. With this, correction calculator 12 can output the calculated output gradation value to source driver circuit 5 as the gradation indicated by the luminance signal included in the video signal.

In addition, correction calculator 12 calculates the corrected luminance value obtained by correcting the target luminance value from the calculated output gradation value. Correction calculator 12 outputs the calculated target luminance value to cumulative stress calculator 13.

Hereinafter, a method for calculating the output gradation value and the corrected luminance value will be described with reference to FIG. 5A and FIG. 5B.

Figure 5A:
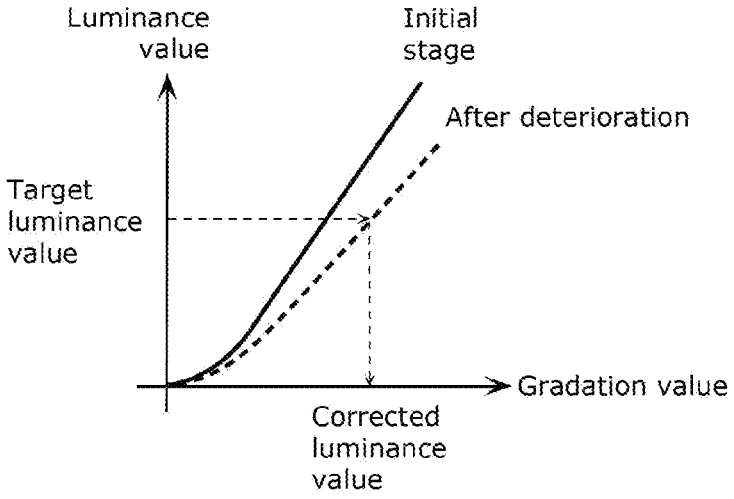
FIG. 5A is a diagram for illustrating a method for calculating a corrected gradation value from the target luminance value according to the embodiment.

FIG. 5A is a diagram for illustrating a method for calculating the corrected gradation value from the target luminance value according to the present embodiment. FIG. 5B is a diagram for illustrating a method for calculating the corrected luminance value from the corrected gradation value according to the present embodiment. FIG. 5A and FIG. 5B show gradation luminance characteristics showing the relationship between the gradation value and the luminance value at the initial stage and after the deterioration of light emitting element 20. The gradation luminance characteristic after deterioration can be obtained by multiplying the gradation luminance characteristic at the initial stage by efficiency residual rate Rt.

Correction calculator 12 can calculate the gradation value corresponding to the target luminance value output from luminance converter 11 as a corrected gradation value obtained by correcting the input gradation value indicated by the luminance signal included in the video signal using the relationship represented by the gradation luminance characteristic after deterioration in FIG. 5A. Then, correction calculator 12 outputs the calculated corrected gradation value as an output gradation value. With this, the input gradation value represented by the luminance signal included in the video signal input from the outside of display device 1 is corrected to the output gradation value and is input to source driver circuit 5.

Figure 5B:
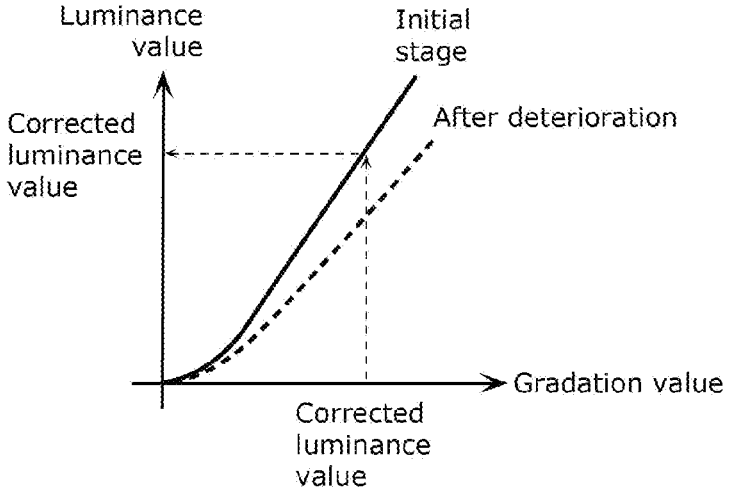
FIG. 5B is a diagram for illustrating a method for calculating a corrected luminance value from a corrected gradation value according to the embodiment.

In addition, correction calculator 12 can calculate the luminance value corresponding to the calculated corrected gradation value as a corrected luminance value obtained by correcting the target luminance value output from luminance converter 11 using the relationship represented by the gradation luminance characteristic after deterioration in FIG. 5B. Then, correction calculator 12 outputs the calculated corrected luminance value to cumulative stress calculator 13.

<Cumulative Stress Calculator 13>

Cumulative stress calculator 13 updates the efficiency residual rate using a cumulative stress amount obtained by converting a stress amount on light emitting element 20 calculated from the corrected luminance value into a first stress amount indicating the stress amount when a reference current flows through light emitting element 20 and accumulating a second stress amount obtained from the converted first stress amount. Here, the second stress amount is obtained by converting the first stress amount according to the frame rate obtained from the video signal in stress amount converter 14, and is obtained by converting the first stress amount into the stress amount suitable for the frame rate.

In addition, the stress amount calculated from the corrected luminance value is a stress amount at a first current flowing through light emitting element 20 when light emitting element 20 is made to emit light with the corrected luminance value, and is a time during which the first current flows through light emitting element 20. Similarly, the stress amount at the reference current is a time during which the reference current flows through light emitting element 20.

For this reason, more specifically, cumulative stress calculator 13 can convert the stress amount calculated from the corrected luminance value into the first stress amount by converting the time during which the first current flows through light emitting element 20 into the time during which the reference current flows through light emitting element 20. In addition, cumulative stress calculator 13 can calculate the cumulative stress amount by calculating a cumulative time obtained by accumulating the time during which the reference current flows through light emitting element 20, which is the second stress amount.

In addition, cumulative stress calculator 13 can update the efficiency residual rate by setting the efficiency residual rate to a new efficiency residual rate calculated from the cumulative time calculated as the cumulative stress amount by using a relationship between a luminance of light emitting element 20 and the cumulative time during which the reference current flows through light emitting element 20.

Figure 6:
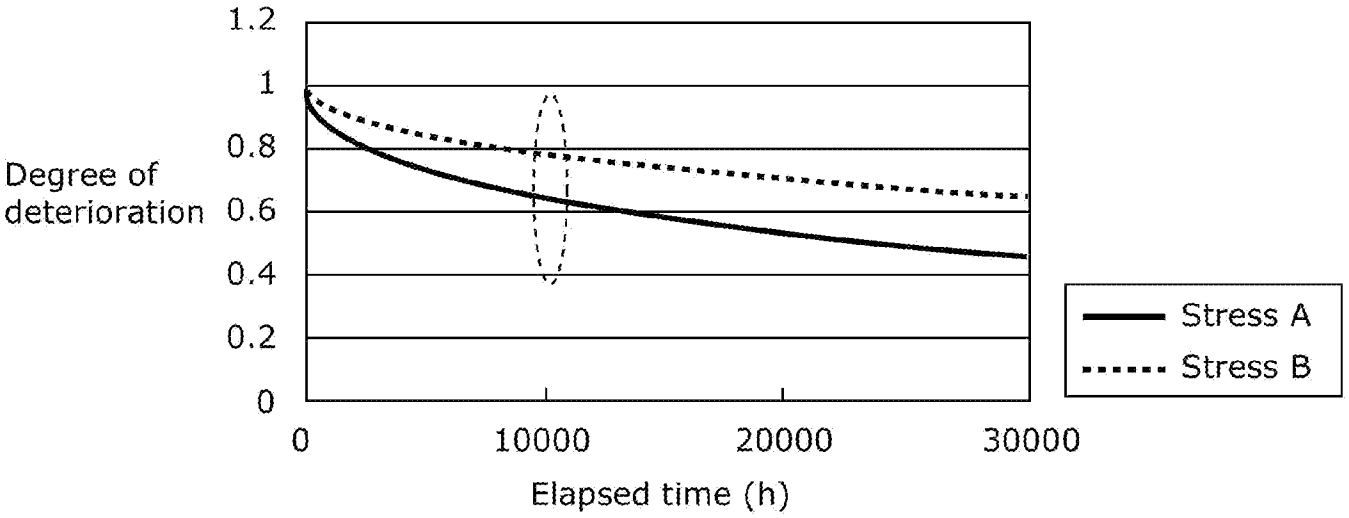
FIG. 6 is a diagram showing the relationships between the elapsed stress time and the degree of deterioration of the light emitting element.

FIG. 6 is a diagram showing the relationship between the elapsed stress time and the degree of deterioration of the light emitting element.

As described above, in a self-luminous element such as an organic EL element, it is known that the light emitting layer included in the self-luminous element deteriorates according to the amount of light emitted, the light emitting time, and the temperature. FIG. 6 shows the degree of deterioration in the elapsed time during which a constant current is continuously applied to the light emitting element with the current applied to the light emitting element as stress. The current applied to the light emitting element is different between stress A and stress B, and stress A>stress B, that is, (current applied as stress A)>(current applied as stress B).

As shown in FIG. 6, it can be seen that when the light emitting element is stressed, the deterioration progresses with the passage of time. In addition, it can be seen that the deterioration progresses more when stress A is applied to the light emitting element than when stress B is applied to the light emitting element. That is, as shown by the dotted line box in FIG. 6, it can be seen that even if the elapsed time is the same, the degree of deterioration differs depending on the stress, and the deterioration progresses with a larger stress.

It should be noted that since the magnitude of the current supplied to light emitting element 20 differs depending on the input gradation value indicated by the luminance signal included in the video signal, that is, it is not constant, it is difficult to express the relationship between the elapsed time and the degree of deterioration of light emitting element 20 easily.

Therefore, in the present embodiment, the degree of deterioration due to the stress amount on light emitting element 20 is evaluated by the degree of deterioration due to the cumulative time (elapsed time) of the time during which a constant current (that is, the reference current) is supplied to light emitting element 20. In this way, the stress amount can be calculated by converting the time of various currents (first current) applied (supplied) to light emitting element 20 into the time during which the reference current flows through light emitting element 20, so that the cumulative stress amount can be calculated by calculating the cumulative time obtained by accumulating the converted time.

Figure 7A:
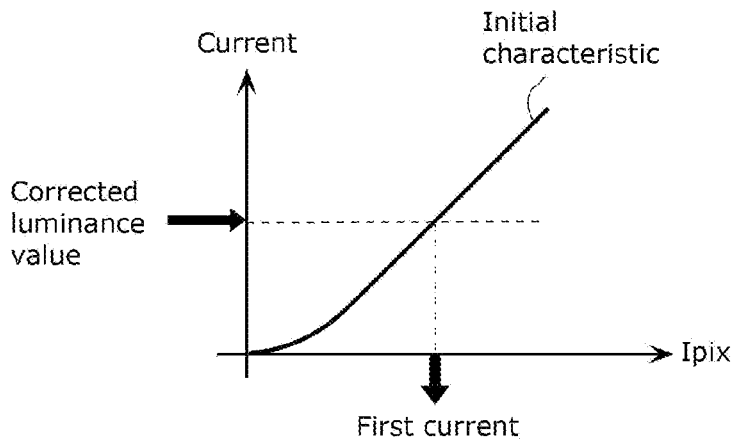
FIG. 7A is a diagram for illustrating a method for calculating a first current value that flows when the light emitting element is made to emit light with the corrected luminance value according to the embodiment.

FIG. 7A is a diagram for illustrating a method for calculating a first current value that flows when light emitting element 20 is made to emit light with the corrected luminance value according to the present embodiment. FIG. 7A shows a curve showing the relationship between the flowing current value and the luminance value in initial light emitting element 20.

Cumulative stress calculator 13 calculates the first current that flows when light emitting element 20 is made to emit light by the luminance value from the corrected luminance value output from correction calculator 12 using the relationship between the flowing current value and the luminance value in initial light emitting element 20 shown by the curve in FIG. 7A.

Figure 7B:
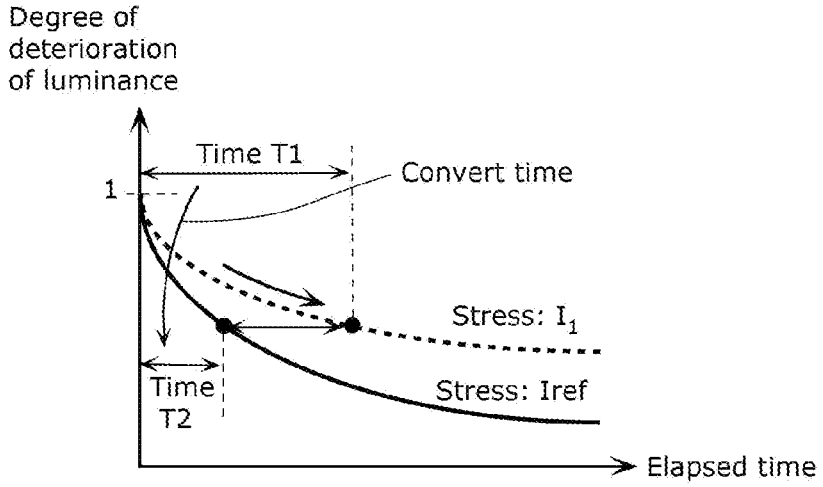
FIG. 7B is a diagram for illustrating a method for converting a stress amount when a first current flows through a light emitting element according to the embodiment into a stress amount when a reference current flows through the light emitting element.

FIG. 7B is a diagram for illustrating a method for converting the stress amount when the first current flows through light emitting element 20 according to the present embodiment into the stress amount when the reference current flows through light emitting element 20. The curve shown in FIG. 7B shows the relationship between the elapsed time and the degree of deterioration of the luminance of light emitting element 20 when the reference current and the first current flow through light emitting element 20 as stress. It should be noted that in FIG. 7B, the degree of deterioration of the luminance of initial light emitting element 20 without any stress is normalized to 1. In addition, each of the two curves shown in FIG. 7B shows the relationship between the elapsed time and the degree of deterioration of the luminance of light emitting element 20 when the frame rate is constant, and is prepared in advance.

Cumulative stress calculator 13 converts the time during which the first current flows into the time during which the reference current flows through light emitting element 20 so that the stress amount is equivalent to the stress amount when the calculated first current is applied to light emitting element 20. More specifically, cumulative stress calculator 13 converts time T1 during which the first current flows into time T2 during which the reference current flows so that the degree of deterioration of the luminance is equivalent to the degree of deterioration of the luminance when the calculated first current is applied to light emitting element 20 for time T1 using the curve shown in FIG. 7B. That is, as shown in FIG. 7B, time T1 in stress I1 which is time T1 during which the first current flows through light emitting element 20 can be converted into time T2 in stress Iref which is time T2 during which the reference current flows through light emitting element 20. In this way, cumulative stress calculator 13 can convert the stress amount calculated from the corrected luminance value into the first stress amount.

Figure 7C:
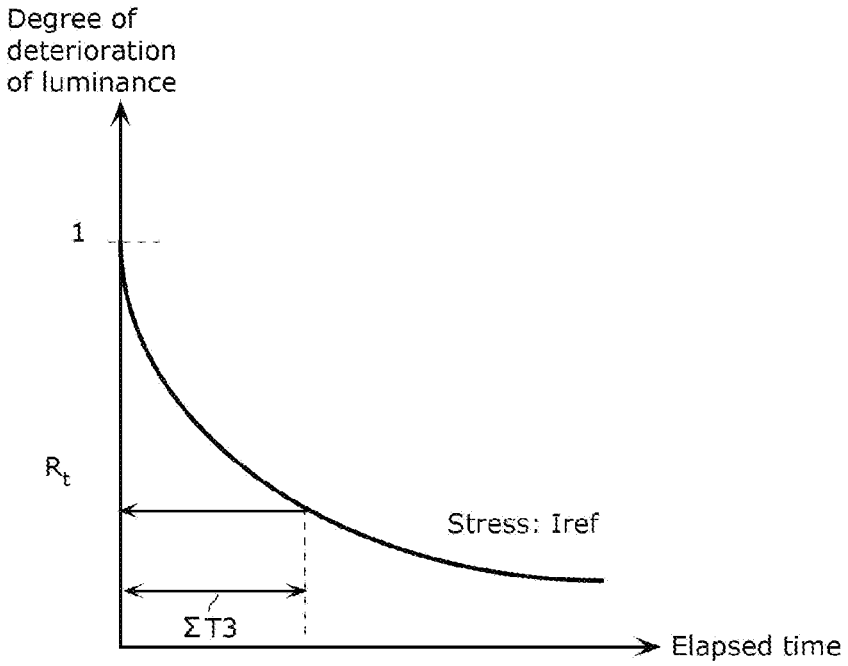
FIG. 7C is a diagram for illustrating a method for calculating the efficiency residual rate from the degree of deterioration of the luminance when a reference current flows through the light emitting element according to the embodiment for a cumulative time.

FIG. 7C is a diagram for illustrating a method for calculating the efficiency residual rate from the degree of deterioration of the luminance when a reference current flows through light emitting element 20 according to the present embodiment for a cumulative time. The curve shown in FIG. 7C shows the relationship between the elapsed time (cumulative time) and the degree of deterioration of the luminance of light emitting element 20 when a reference current flows through light emitting element 20 as stress when the frame rate is constant.

Cumulative stress calculator 13 outputs converted time T2 to stress amount converter 14, and acquires time T3 obtained by further converting converted time T2 according to the frame rate from stress amount converter 14. Cumulative stress calculator 13 calculates cumulative time ΣT3 for acquired time T3 by further adding acquired time T3 to the previously acquired and accumulated time ΣT3. Then, cumulative stress calculator 13 calculates efficiency residual rate Rt from cumulative time ΣT3 using the curve shown in FIG. 7C.

In the curve shown in FIG. 7C, since the emission luminance when cumulative time ΣT3 is 0 is not deteriorated, it corresponds to the emission luminance of initial light emitting element 20. For this reason, the emission luminance of light emitting element 20 in cumulative time ΣT3 can be expressed by the ratio of the emission luminance after the deterioration of light emitting element 20 to the initial emission luminance of light emitting element 20. That is, cumulative stress calculator 13 can calculate efficiency residual rate Rt from cumulative time ΣT3 using the curve shown in FIG. 7C. It should be noted that in FIG. 7C, the undegraded emission luminance of initial light emitting element 20 is normalized to 1.

<Stress Amount Converter 14>

Stress amount converter 14 converts the first stress amount into the second stress amount by acquiring the frame rate obtained from the video signal and multiplying the first stress amount by a conversion coefficient corresponding to the acquired frame rate. That is, stress amount converter 14 converts the first stress amount calculated by cumulative stress calculator 13 into the second stress amount suitable for the acquired frame rate.

In the present embodiment, stress amount converter 14 acquires the frame rate of the screen (video signal) displayed on display screen 3 when light emitting element 20 is made to emit light with the corrected luminance value. In addition, the stress amount on light emitting element 20 is treated as the time during which the current applied to light emitting element 20 flows. For this reason, stress amount converter 14 converts time T2, which is the first stress amount calculated by cumulative stress calculator 13, into time T3 suitable for the acquired frame rate.

By the way, in recent years, the frame rate has come to change depending on the content of the video displayed on display screen 3. In addition, time T2, which is the first stress amount, is the stress amount calculated by cumulative stress calculator 13 assuming that the frame rate is constant.

Therefore, when the frame rate changes, time T2, which is the first stress amount, includes an error by the amount of change from the constant frame rate. For this reason, stress amount converter 14 converts time T2, which is the first stress amount calculated by cumulative stress calculator 13, so that time T2 is a time in consideration of the amount of change from the constant frame rate, that is, a time suitable for the changed frame rate. In the present embodiment, stress amount converter 14 converts time T2 into time T3 suitable for the changed frame rate by multiplying time T2 which is the first stress amount calculated by cumulative stress calculator 13 by the conversion coefficient according to the frame rate.

[Method for Driving Display Device 1]

Next, the method for driving display device 1 configured as described above will be described.

Figure 8:
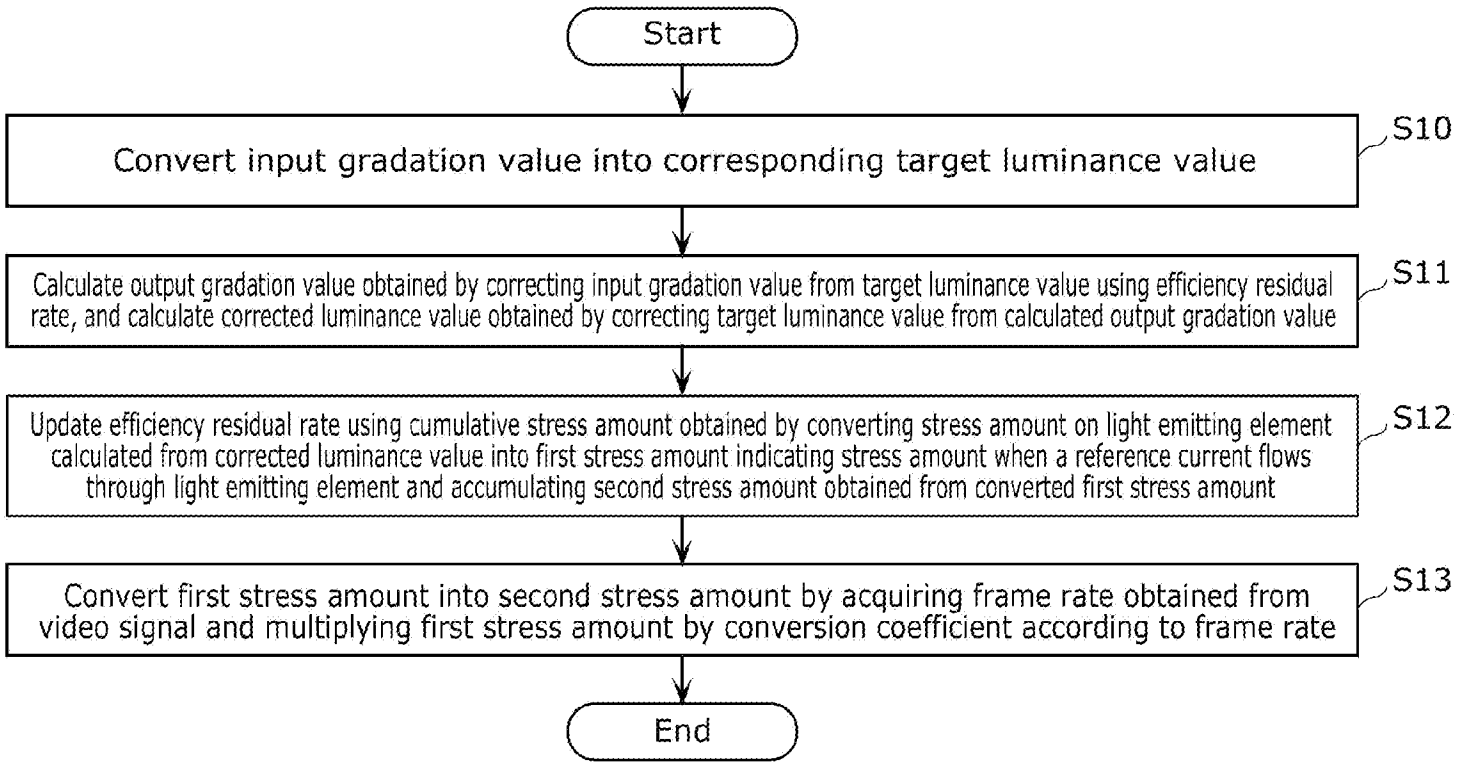
FIG. 8 is a flowchart showing an example of a method for driving display device 1 according to the embodiment.

FIG. 8 is a flowchart showing an example of a method for driving display device 1 according to the present embodiment. FIG. 8 shows the processing of correction circuit 10 included in display device 1 as an example of the method for driving display device 1.

First, correction circuit 10 converts the input gradation value indicated by the luminance signal included in the video signal input from the outside of display device 1 into the corresponding target luminance value (S10).

Next, correction circuit 10 calculates the output gradation value obtained by correcting the input gradation value from the target luminance value converted in step S10 using the efficiency residual ratio, and calculates the corrected luminance value obtained by correcting the target luminance value from the output gradation value (S11). This efficiency residual rate is calculated by cumulative stress calculator 13 in the previous process or the like.

Next, correction circuit 10 updates the efficiency residual rate using a cumulative stress amount obtained by converting a stress amount on light emitting element 20 calculated from the corrected luminance value calculated in step S11 into a first stress amount at a reference current and accumulating a second stress amount obtained from the converted first stress amount (S12). Here, the first stress amount at the reference current is the stress amount when the reference current flows through light emitting element 20, and is evaluated by the time during which the reference current flows through light emitting element 20 in the present embodiment. It should be noted that the second stress amount is obtained by converting the first stress amount so as to be suitable for the frame rate obtained from the video signal in next step S13.

Then, when performing step S12, by acquiring a frame rate obtained from the video signal and multiplying the first stress amount by a conversion coefficient corresponding to the acquired frame rate, correction circuit 10 converts the first stress amount into the second stress amount suitable for the frame rate (S13).

Effects, Etc.

As described above, according to the display device according to the present embodiment, display unevenness can be reduced even when the frame rate changes. More specifically, even when the frame rate changes, the stress amount suitable for the changed frame rate can be calculated, so that the cumulative stress amount can be calculated accurately. For this reason, since the degree of deterioration of light emitting element 20 can be accurately predicted using the efficiency residual rate, the input gradation value corrected in consideration of the degree of deterioration of light emitting element 20, that is, the output gradation value can be calculated. With this, since each light emitting element 20 can be corrected to a uniform light emitting luminance regardless of the degree of deterioration of each light emitting element 20, display unevenness can be reduced.

In addition, according to the display device according to the present embodiment, the stress amount is evaluated by the time during which the reference current flows through light emitting element 20, so that even if the frame rate changes, the stress amount suitable for the changed frame rate can be calculated, and the cumulative stress amount can be calculated accurately.

Hereinafter, a specific aspect of stress amount converter 14 included in correction circuit 10 according to the present embodiment will be described with reference to Example 1 and Example 2.

Example 1

First, in Example 1, a case where stress amount converter 14 selects a conversion coefficient according to the acquired frame rate using a look-up table (LUT) prepared in advance will be described.

[Configuration of Correction Circuit 10 Etc. According to Example 1]

Figure 9:
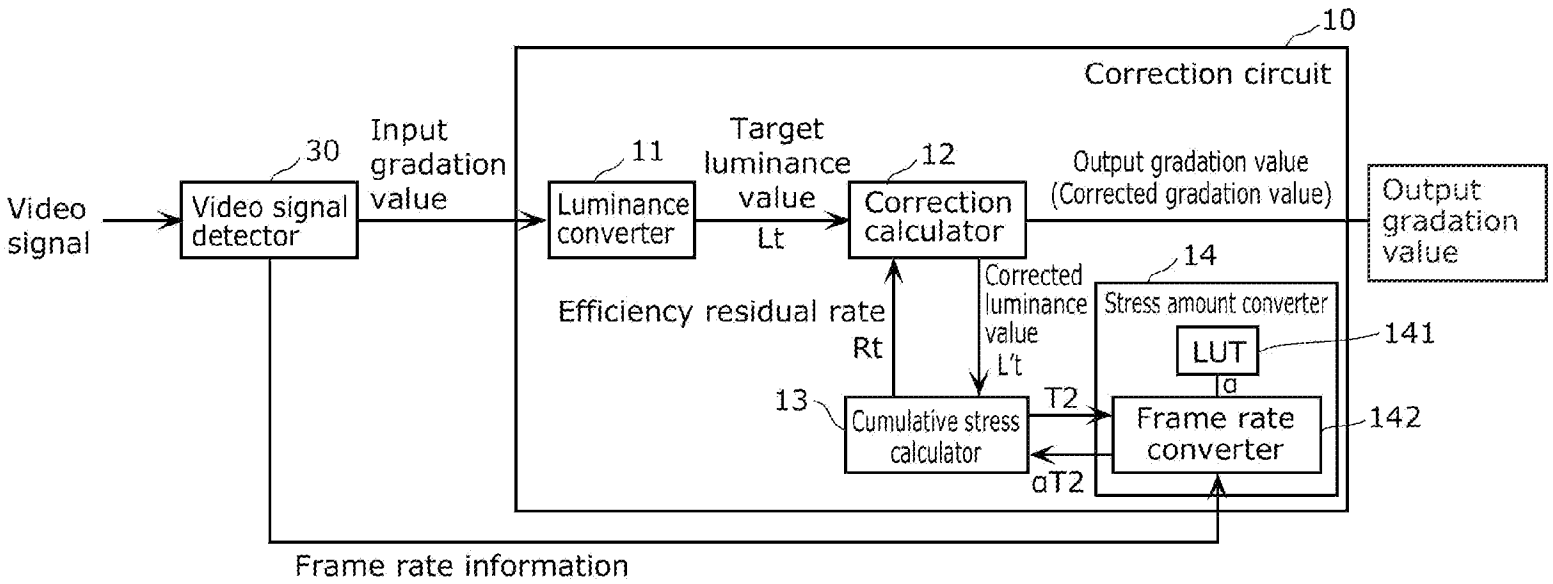
FIG. 9 is a block diagram showing an example of the configuration of the correction circuit according to Example 1 of the embodiment.

FIG. 9 is a block diagram showing an example of the configuration of correction circuit 10 according to Example 1 of the present embodiment. FIG. 9 shows a configuration when the video signal includes frame rate information, and further includes video signal detector 30. It should be noted that the same elements as those in FIG. 3 are designated by the same reference numerals, and detailed description thereof will be omitted.

[Video Signal Detector 30]

Video signal detector 30 acquires a video signal, extracts frame rate information from the acquired video signal, and outputs the frame rate information to stress amount converter 14. In addition, video signal detector 30 outputs the input gradation value indicated by the luminance signal included in the acquired video signal to luminance converter 11.

[Stress Amount Converter 14]

Stress amount converter 14 converts the first stress amount into the second stress amount by acquiring the frame rate obtained from the video signal and multiplying the first stress amount by a conversion coefficient corresponding to the acquired frame rate. In the present example, stress amount converter 14 includes LUT 141 and frame rate converter 142, as shown in FIG. 9.

<LUT141>

LUT 141 is a look-up table corresponding to various frame rates, and stores a plurality of frame rates and a conversion coefficient associated with each of the plurality of frame rates in advance.

FIG. 10A and FIG. 10B are diagrams showing an example of a look-up table according to Example 1 of the present embodiment. FIG. 10A and FIG. 10B show an example of conversion coefficients when the frame rates are 20 frames per second (FPS), 30 FPS, 40 FPS, 48 FPS, 50 FPS, 60 FPS, 120 FPS, 196 FPS and 240 FPS.

FIG. 10A shows an example of the value of the conversion coefficient when time T2 indicating the first stress amount is calculated as the basis for 1 second. FIG. 10B shows an example of the value of the conversion coefficient when time T2 indicating the first stress amount is calculated with, for example, 60 FPS as a reference.

<Frame Rate Converter 142>

Frame rate converter 142 acquires the frame rate obtained from the video signal and selects the conversion coefficient corresponding to the acquired frame rate from the lookup table. More specifically, frame rate converter 142 acquires the frame rate obtained from the video signal by acquiring the frame rate information from video signal detector 30. Frame rate converter 142 selects the conversion coefficient corresponding to the acquired frame rate from LUT 141.

In addition, frame rate converter 142 converts the first stress amount into the second stress amount by multiplying the first stress amount by the selected conversion coefficient.

It should be noted that in the example shown in FIG. 9, the target luminance value is indicated by Lt, the corrected luminance value is indicated by L't, and the conversion coefficient selected by frame rate converter 142 from LUT 141 is indicated by $\alpha$. In this case, frame rate converter 142 converts time T2, which is the first stress amount, into time $\alpha$T2, which is the second stress amount suitable for the acquired frame rate, that is, time T3 by multiplying time T2 which is the first stress amount by selected conversion coefficient $\alpha$.

Effects, Etc.

As described above, according to display device 1 according to the present example, the stress amount (second stress amount) at the reference current suitable for the changing frame rate can be accurately calculated by using the lookup table. With this, display device 1 according to the present example can accurately calculate the cumulative stress amount by using the second stress amount at the reference current suitable for the changing frame rate even when the frame rate changes. For this reason, since display device 1 according to the present example can accurately predict the degree of deterioration of the light emitting element by the efficiency residual rate, the input gradation value corrected in consideration of the degree of deterioration of the light emitting element, that is, the output gradation value can be calculated. With this, each light emitting element can be corrected to a uniform light emitting luminance regardless of the degree of deterioration of each light emitting element, and display unevenness can be reduced.

In addition, in the present example, display device 1 according to the present example can be realized on a small circuit scale by using a lookup table.

It should be noted that in the above, the case where the video signal includes frame rate information has been described as an example, but the present disclosure is not limited thereto. Similarly, display unevenness can be reduced even when the video signal does not include frame rate information. This will be described with reference to FIG. 11.

Figure 11:
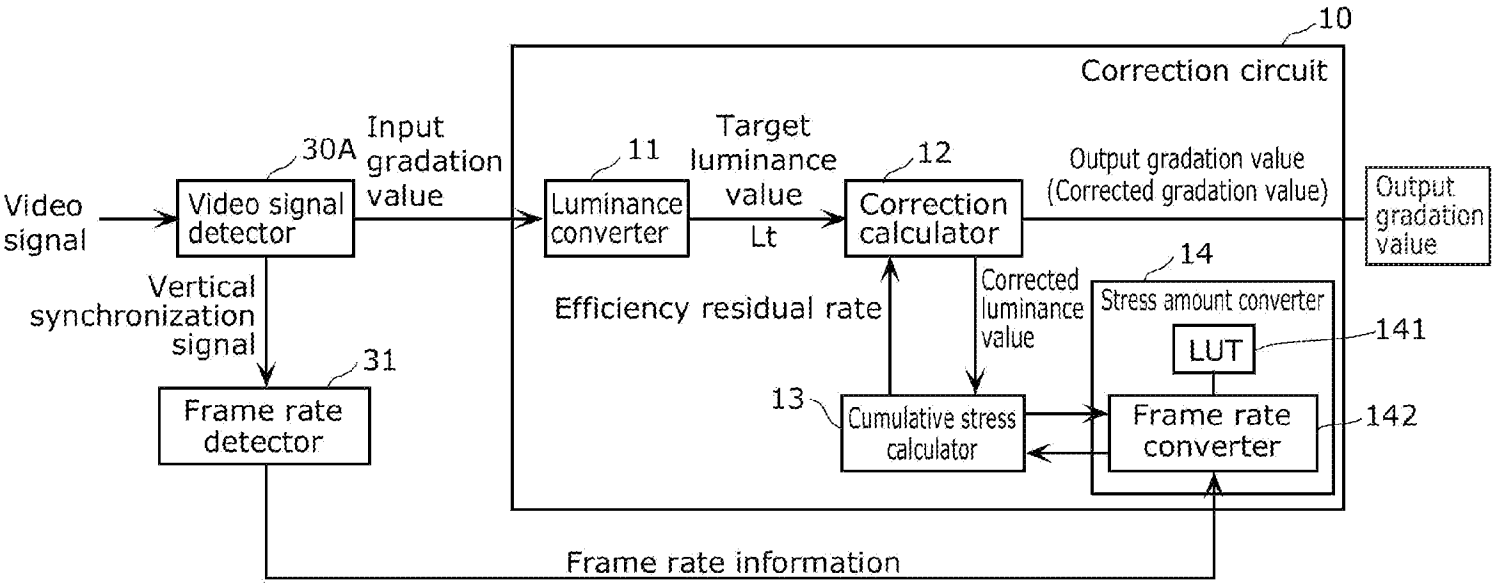
FIG. 11 is a block diagram showing another example of the configuration of the correction circuit according to Example 1 of the embodiment.
Figure 12:
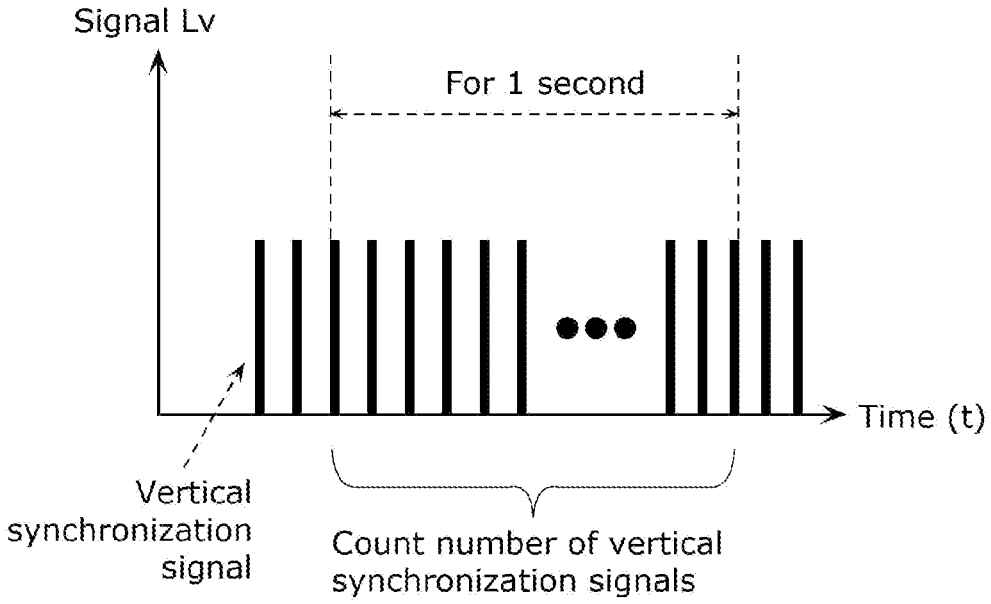
FIG. 12 is a diagram for illustrating a method for detecting frame rate information from a vertical synchronization signal.

FIG. 11 is a block diagram showing another example of the configuration of correction circuit 10 according to Example 1 of the present embodiment. It should be noted that the same elements as those in FIG. 3 and FIG. 9 are designated by the same reference numerals, and detailed description thereof will be omitted. FIG. 12 is a diagram for illustrating a method for detecting frame rate information from the vertical synchronization signal.

FIG. 11 shows a configuration when the video signal does not include frame rate information. In the configuration shown in FIG. 11, frame rate detector 31 is added and the configuration of video signal detector 30A is different, as compared with the configuration shown in FIG. 9.

Video signal detector 30A acquires a video signal and divides the acquired video signal into a luminance signal and a vertical synchronization signal. Video signal detector 30A outputs the vertical synchronization signal to stress amount converter 14, and outputs the input gradation value indicated by the luminance signal to luminance converter 11.

Frame rate detector 31 detects frame rate information from the video signal. Frame rate detector 31 outputs the detected frame rate information to stress amount converter 14.

More specifically, as shown in FIG. 12, frame rate detector 31 detects the number of frame rates (FPS) by counting the number of vertical synchronization signals input from video signal detector 30A for one second. Frame rate detector 31 outputs the detected number of frame rates as frame rate information to frame rate converter 142. It should be noted that when the frame rate of the vertical synchronization signal input from video signal detector 30A changes frequently, frame rate detector 31 may use the average value for several seconds as the frame rate information. This can reduce the error. In addition, even when the frame rate of the vertical synchronization signal input from video signal detector 30A changes, frame rate detector 31 can ignore the error as long as it does not change for several minutes or more, for example.

Frame rate converter 142 acquires the frame rate obtained from the video signal by acquiring the frame rate information detected by frame rate detector 31 from the video signal. Others are as described above, and the following description will be omitted.

Example 2

Next, in Example 2, a case where stress amount converter 14 obtains a conversion coefficient according to the acquired frame rate by applying the acquired frame rate to a calculation formula prepared in advance will be described.

[Configuration of Correction Circuit 10 Etc. According to Example 2]

Figure 13:
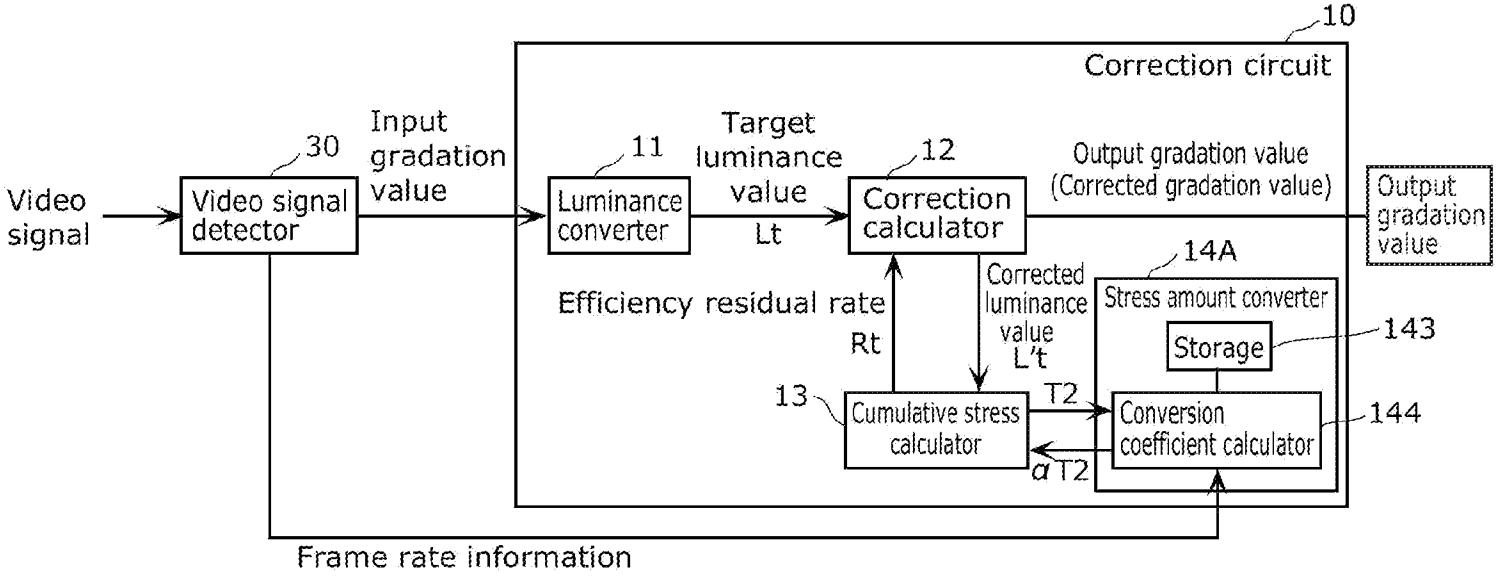
FIG. 13 is a block diagram showing an example of the configuration of the correction circuit according to Example 2 of the embodiment.

FIG. 13 is a block diagram showing an example of the configuration of correction circuit 10 according to Example 2 of the present embodiment. It should be noted that the same elements as those in FIG. 3 and FIG. 9 are designated by the same reference numerals, and detailed description thereof will be omitted. FIG. 13 shows a configuration when the video signal includes frame rate information. Correction circuit 10 shown in FIG. 13 has a different configuration of stress amount converter 14A as compared with correction circuit 10 shown in FIG. 9.

[Stress Amount Converter 14A]

Stress amount converter 14A converts the first stress amount into the second stress amount by acquiring the frame rate obtained from the video signal and multiplying the first stress amount by a conversion coefficient corresponding to the acquired frame rate. In the present example, stress amount converter 14A includes storage 143 and conversion coefficient calculator 144, as shown in FIG. 13.

<Storage 143>

Storage 143 stores a calculation formula represented by a ratio having the frame rate as a denominator for calculating the conversion coefficient.

Here, the calculation formula will be described. Assuming that the conversion coefficient is $\alpha$ and the frame rate of the video signal is FR1, the calculation formula can be expressed by following Equation 1 or Equation 2.

[Math. 1]

$$\text{Conversion coefficient } \alpha = 1/FR1 \quad \text{(Equation 1)}$$

[Math. 2]

$$\text{Conversion coefficient } \alpha = 60/FR1 \quad \text{(Equation 2)}$$

It should be noted that when time T2 indicating the first stress amount is calculated as the basis for 1 second, Equation 1 is used. On the other hand, when time T2 indicating the first stress amount is calculated with, for example, 60 FPS as a reference, Equation 2 is used.

<Conversion Coefficient Calculator 144>

Conversion coefficient calculator 144 obtains the conversion coefficient according to the frame rate by acquiring the frame rate obtained from the video signal and applying the acquired frame rate to the calculation formula. More specifically, conversion coefficient calculator 144 acquires the frame rate obtained from the video signal by acquiring the frame rate information from video signal detector 30. Conversion coefficient calculator 144 can obtain the conversion coefficient according to the frame rate by applying the acquired frame rate to the calculation formula stored in storage 143.

In addition, conversion coefficient calculator 144 converts the first stress amount into the second stress amount by multiplying the first stress amount by the conversion coefficient obtained from the calculation formula.

It should be noted that also in the example shown in FIG. 13, the target luminance value is indicated by Lt, the corrected luminance value is indicated by L't, and the conversion coefficient obtained by conversion coefficient calculator 144 using the calculation formula is indicated by $\alpha$. In this case, conversion coefficient calculator 144 converts time T2, which is the first stress amount, into time $\alpha$T2, which is the second stress amount suitable for the acquired frame rate, that is, time T3 by multiplying time T2 which is the first stress amount by conversion coefficient $\alpha$ obtained from the calculation formula.

Effects, Etc.

As described above, according to display device 1 according to the present example, the stress amount (second stress amount) at the reference current suitable for the changing frame rate can be accurately calculated by using the calculation formula stored in advance. With this, display device 1 according to the present example can accurately calculate the cumulative stress amount by using the second stress amount at the reference current suitable for the changing frame rate even when the frame rate changes. For this reason, since display device 1 according to the present example can accurately predict the degree of deterioration of the light emitting element by the efficiency residual rate, the input gradation value corrected in consideration of the degree of deterioration of the light emitting element, that is, the output gradation value can be calculated. With this, each light emitting element can be corrected to a uniform light emitting luminance regardless of the degree of deterioration of each light emitting element, and display unevenness can be reduced.

In addition, in the present example, by using the calculation formula stored in advance, the frame rates that can be responded to are not discrete and the frame rate that can be responded to is not limited, so that display device 1 according to the present example, which can seamlessly respond to changes in the frame rate, can be realized.

It should be noted that in the above, the case where the video signal includes frame rate information has been described as an example, but the present disclosure is not limited thereto. Similarly, display unevenness can be reduced even when the video signal does not include frame rate information. This will be described with reference to FIG. 14.

Figure 14:
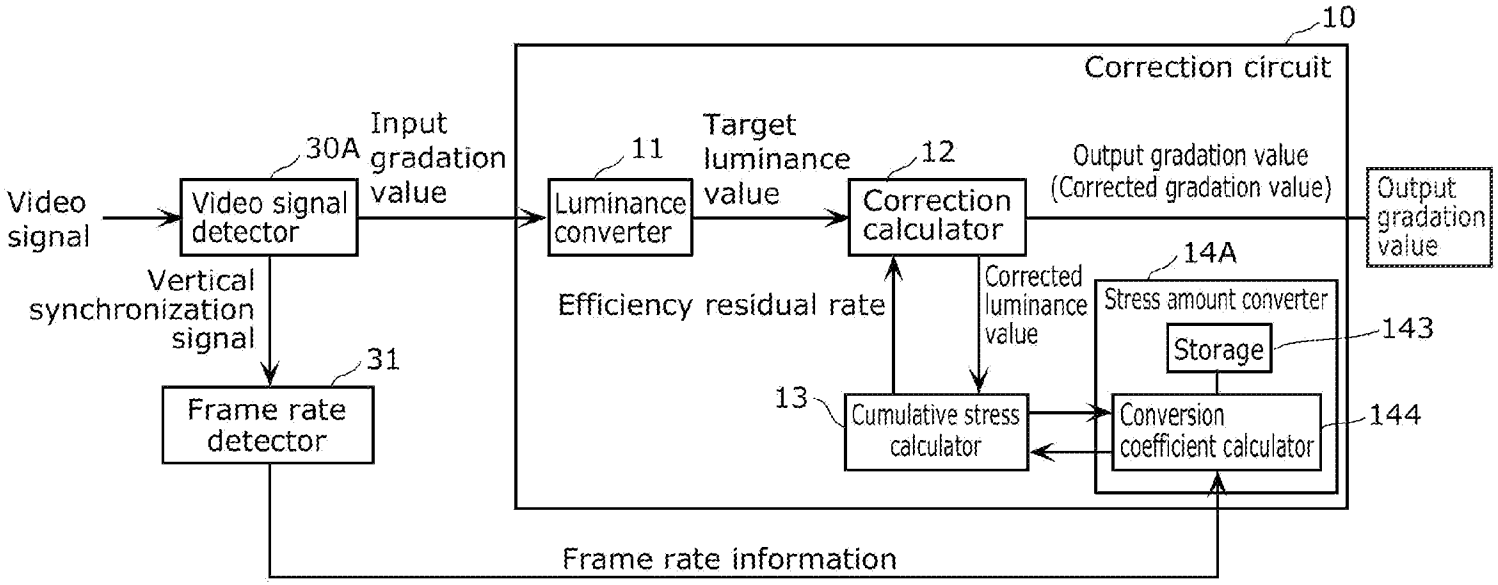
FIG. 14 is a block diagram showing another example of the configuration of the correction circuit according to Example 2 of the embodiment.

FIG. 14 is a block diagram showing another example of the configuration of correction circuit 10 according to Example 2 of the present embodiment. It should be noted that the same elements as those in FIG. 3, FIG. 9 and FIG. 13 are designated by the same reference numerals, and detailed description thereof will be omitted.

FIG. 11 shows a configuration when the video signal does not include frame rate information. In the configuration shown in FIG. 14, frame rate detector 31 is added and the configuration of video signal detector 30A is different, as compared with the configuration shown in FIG. 13.

It should be noted that video signal detector 30A is as described with reference to FIG. 11 in Example 1, and thus the description thereof will be omitted here. Frame rate detector 31 will be described focusing on the points different from those of Example 1.

Frame rate detector 31 detects frame rate information from the video signal. Frame rate detector 31 outputs the detected frame rate information to stress amount converter 14A.

As described with reference to FIG. 12, frame rate detector 31 detects the number of frame rates (FPS) by counting the number of vertical synchronization signals input from video signal detector 30A for one second. Frame rate detector 31 outputs the detected number of frame rates as frame rate information to conversion coefficient calculator 144.

Conversion coefficient calculator 144 acquires the frame rate obtained from the video signal by acquiring the frame rate information detected by frame rate detector 31 from the video signal. Others are as described above, and the following description will be omitted.

Although display device 1 has been described by way of the embodiment and examples above, display device 1 is not limited to the embodiment described above.

For example, correction circuit 10 described above is provided with, for example, a gain calculator, and when the efficiency residual rate obtained by the cumulative stress calculator is small, the efficiency residual rate may be amplified by the gain calculated by the gain calculator.

In addition, forms obtained by making various modifications to the present embodiment that can be conceived by those skilled in the art, as well as forms constructed by combining structural components in different embodiments, without departing from the spirit of the present disclosure, are also included in the scope of the present disclosure.

Although the present invention has been described and illustrated in detail, it is clearly understood that the same is by way of example only and is not to be taken by way of limitation, the scope of the present invention being limited only by the terms of the appended claims.

INDUSTRIAL APPLICABILITY

The present disclosure can be used for display devices and driving methods for display devices, and in particular, display devices and driving methods for display devices in technical fields such as flat-screen televisions and personal computer displays that have self-luminous elements and require a large screen and high resolution.

The invention claimed is:

1. A display device including a display screen in which a plurality of pixels each including a light emitting element are arranged in a matrix, the display device comprising:

a correction circuit that corrects an input gradation value indicated by a luminance signal included in a video signal, wherein the correction circuit includes:

a luminance converter that converts the input gradation value into a target luminance value corresponding to the input gradation value;

a correction calculator that calculates an output gradation value obtained by correcting the input gradation value from the target luminance value and calculates a corrected luminance value obtained by correcting the target luminance value from the output gradation value using an efficiency residual rate which is an index indicating a degree of deterioration of the light emitting element and which indicates a residual rate of a luminous efficiency of the light emitting element;

a cumulative stress calculator that updates the efficiency residual rate using a cumulative stress amount obtained by converting a stress amount on the light emitting element calculated from the corrected luminance value into a first stress amount indicating the stress amount when a reference current flows through the light emitting element and accumulating a second stress amount obtained from the first stress amount converted and obtained by converting the first stress amount according to a frame rate obtained from the video signal; and a stress amount converter that converts the first stress amount into the second stress amount by acquiring the frame rate obtained from the video signal and multiplying the first stress amount by a conversion coefficient corresponding to the frame rate acquired.

2. The display device according to claim 1, wherein the stress amount calculated from the corrected luminance value is a stress amount at a first current flowing through the light emitting element when the light emitting element is made to emit light with the corrected luminance value, the stress amount at the first current is a time during which the first current flows through the light emitting element, the stress amount at the reference current is a time during which the reference current flows through the light emitting element, the cumulative stress calculator converts the stress amount calculated from the corrected luminance value into the first stress amount by converting the time during which the first current flows through the light emitting element into the time during which the reference current flows through the light emitting element, and calculates the cumulative stress amount by calculating a cumulative time obtained by accumulating a time corresponding to the frame rate, the time being the time during which the reference current flows through the light emitting element and being the second stress amount.

3. The display device according to claim 2, wherein the efficiency residual rate is represented by a ratio of an emission luminance after deterioration of the light emitting element to an initial emission luminance of the light emitting element, and the cumulative stress calculator updates the efficiency residual rate by setting the efficiency residual rate to a new efficiency residual rate calculated from the cumulative time calculated as the cumulative stress amount by using a relationship between a luminance of the light emitting element and the cumulative time during which the reference current flows through the light emitting element.

4. The display device according to claim 1, wherein the stress amount converter includes:

a look-up table that stores a plurality of frame rates and a conversion coefficient associated with each of the plurality of frame rates in advance; and a frame rate converter that converts the first stress amount into the second stress amount by acquiring the frame rate obtained from the video signal, selecting, from the lookup table, the conversion coefficient corresponding to the frame rate acquired, and multiplying the first stress amount by the conversion coefficient.

5. The display device according to claim 1, wherein the stress amount converter includes:

a storage that stores a calculation formula for calculating the conversion coefficient, the calculation formula expressed by a ratio having the frame rate as a denominator; and a conversion coefficient calculator that converts the first stress amount into the second stress amount by acquiring the frame rate obtained from the video signal, obtaining the conversion coefficient corresponding to the frame rate by applying the frame rate acquired to the calculation formula, and multiplying the first stress amount by the conversion coefficient.

6. A method for driving a display device including a display screen in which a plurality of pixels each including a light emitting element are arranged in a matrix, the method comprising:

correcting an input gradation value indicated by a luminance signal included in a video signal, wherein the correcting includes:

converting the input gradation value into a target luminance value corresponding to the input gradation value;

calculating an output gradation value obtained by correcting the input gradation value from the target luminance value and calculates a corrected luminance value obtained by correcting the target luminance value from the output gradation value using an efficiency residual rate which is an index indicating a degree of deterioration of the light emitting element and which indicates a residual rate of a luminous efficiency of the light emitting element;

updating the efficiency residual rate by converting a stress amount on the light emitting element calculated from the corrected luminance value into a first stress amount indicating the stress amount when a reference current flows through the light emitting element, and accumulating a second stress amount obtained from the first stress amount converted and obtained by converting the first stress amount according to a frame rate obtained from the video signal; and converting the first stress amount into the second stress amount by acquiring the frame rate obtained from the video signal and multiplying the first stress amount by a conversion coefficient corresponding to the frame rate acquired.

* * * * *